US006543104B2

(12) United States Patent
Wirz

(10) Patent No.: US 6,543,104 B2
(45) Date of Patent: Apr. 8, 2003

(54) YARN TEXTURING NOZZLE

(75) Inventor: Armin Wirz, Ossingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/935,203

(22) Filed: Aug. 22, 2001

(65) Prior Publication Data

US 2002/0035770 A1 Mar. 28, 2002

(30) Foreign Application Priority Data

Sep. 1, 2000 (DE) ..... 100 43 002

(51) Int. Cl.[7] ..... D02G 1/12
(52) U.S. Cl. ..... 28/255; 28/256
(58) Field of Search ..... 28/247, 250, 254, 28/255, 256, 257, 262, 263, 264, 265, 267, 271, 221; 264/168, 211.15, 282, 339, 518

(56) References Cited

U.S. PATENT DOCUMENTS

| | | | | | |
|---|---|---|---|---|---|
| 3,643,843 | A | * | 2/1972 | Havlas et al. | 28/255 |
| 3,714,686 | A | * | 2/1973 | Schmid et al. | 28/255 |
| 3,824,656 | A | * | 7/1974 | Bauch | 28/255 |
| 4,188,691 | A | * | 2/1980 | Matsumoto et al. | 28/263 |
| 4,268,940 | A | * | 5/1981 | Kuroda et al. | 28/255 |
| 4,631,790 | A | * | 12/1986 | Nabulon | 28/255 |
| 4,691,947 | A | * | 9/1987 | Burkhardt et al. | 28/255 |
| 4,724,588 | A | * | 2/1988 | Runkel | 28/255 |
| 4,782,566 | A | * | 11/1988 | Nabulon et al. | 28/255 |
| 4,854,019 | A | * | 8/1989 | Nabulon | 28/255 |
| 5,351,374 | A | * | 10/1994 | Nabulon et al. | 28/271 |
| 5,497,538 | A | * | 3/1996 | Graf et al. | 28/255 |

FOREIGN PATENT DOCUMENTS

| | | |
|---|---|---|
| DE | 2036856 | 7/1970 |
| DE | 2061814 | 12/1970 |
| DE | 1995522 | 5/2001 |
| EP | 0163039 | 12/1985 |
| EP | 0212175 | 3/1987 |
| EP | 0282815 | 9/1988 |
| EP | 0632150 | 1/1995 |

* cited by examiner

*Primary Examiner*—Amy B. Vanatta
(74) *Attorney, Agent, or Firm*—Dority & Manning

(57) ABSTRACT

A nozzle for the treatment of threads is divided in the conveying direction into a conveying part, a compression section and a guiding part. The compression section, for the purpose of forming a yarn plug, includes fixedly arranged radially and axially directed lamellar. The ends of the lamellar which face the guiding part are neither in contact with each other nor with any surrounding parts of the nozzle so that fibers which are located in the gaps between the lamellar, and which radially exit the channel being formed by the lamellar can reach an inlet funnel of the guiding part or a plug guide tube respectively, without colliding with any edges.

9 Claims, 2 Drawing Sheets

YARN TEXTURING NOZZLE

BACKGROUND

The invention concerns a yarn texturing nozzle having a compression section. A nozzle of this kind is described for example in the German patent application DE 20 36 856. The yarn entering from above into the nozzle is conveyed by a hot-air stream to a compression section which is provided with openings that are for example of slot shape. By lateral escape of the injected air, a compression of the endless fibre and thus also a deceleration occurs due to the rate of speed reduction within the passage channel. The thereby formed yarn plug is relatively slowly discharged from the nozzle and is thereby cooled down. A rotary cooling drum can be used, on whose surface the compressed yarn is laid and whereby through perforations in the drum air of lower temperature than in the nozzle prevails, e.g. room air, for the cooling of the yarn.

The invention relates to the compression section of a texturing nozzle, in particular to a BCF texturing nozzle, for high speeds. The compression section of a texturing nozzle is conventionally made up of an upper lamellar holder, an end piece and a number of lamellar. In a modified exemplified embodiment, the compression section can also be a tube type piece, which over a section of its length is being provided with a number of longitudinal slots.

The texturing air and the yarn enter the compression section from above at high speed, that is in the flow direction of the fibres or the air respectively. In the area of the compression section, the air flows more or less radially all of a sudden through the slots or the gaps respectively between the lamellar and to a large extent discharges outward to the outside of the lamellar. This causes a reduction of the air speed within the longitudinal channel of the nozzle. Thus the yarn is decelerated and forms a plug which fills the whole diameter of the slotted part, that is the compression section. The plug then slides further downwards through a plug guide tube and further on to a cooling drum or to a conveying device, in particular a pair of rollers. It cannot be prevented that at this position at which the air leaves the slot, single fibrils can be loosened from the yarn and be pulled more or less far outward radially into the slots. Loops can also leave the slots extending beyond the outer edges of the lamellar, thereby said loops can get mutually entangled with loops extending from the neighboring slots. Since the loops or fibres between the slots exiting laterally from the actual yarn or plug guide tube respectively, move downwards together with the plug, they hit the end piece, or in the case of another exemplified embodiment hit an edge or pocket respectively, forming the end of the slot. Thus single loops may remain hooked and thus be pulled far out from the plug or even get torn off. In practice, said protruding loops or filament parts in the finished yarn are known as "pullers" (Zupfers), which can cause difficulties during further processing.

SUMMARY

The improved compression section consists of a tube type piece with slots in the longitudinal direction. According to the invention, these slots are completely open at their lower ends and the lamellar formed by these slots area only connected with each other at the upper end, or they are connected to each other at a distance from the lower end in circumferential direction and in opposite direction to the nozzle. In other words, the lamellar are fastened at the air or the yarn entering point respectively, or close to it at the compression section or the lamellar holder respectively. They can also be fastened to a flange, which again is screwed onto a conveying means at the inlet side of the texturing nozzle or which is fastened with other fastening means. In the outflow direction of the air or in conveying direction of the plug respectively, the lamellar are without contact to parts surrounding the nozzle, in particular without contact to an end piece or a guiding part for the plug succeeding the compression section. The plug guide tube following the compression section, i.e. the portion opposite the free ends of the lamellar, forms, together with the lower end of the compression section, a narrow gap, in particular a truncated cone shaped gap.

Since the ends of the lamellar are free in the downward direction and without contact to the surrounding parts of the nozzle, the filament loops exiting the slots or gaps respectively between the lamellar have no chance to entangle or to remain hooked, whereat the formation of pullers (Zupfer) or broken fibrils is suppressed or considerably reduced respectively. If the fibrils exiting between the lamellar hit the truncated cone-shaped inlet part of the guiding part or end piece respectively, then they come to lay on a smooth surface without niches and edges, and therefore, the risk of pulling-out from the plug does practically not exist anymore. Thus, with the suggested configuration of the compression section the running reliability of the texturing nozzle is considerably increased.

The compression section according to the invention can be used for all types of nozzles by which a yarn plug is formed, that is for instance also for the type of a plug formation through friction within the compression section, or with nozzles by which the plug formation is controlled by a cooling drum succeeding the texturing nozzle, or with nozzles, which are succeeded by a pair of rollers for controlling the plug formation.

As mentioned, it is an object of the invention to increase the operating reliability of a nozzle, in that a compact plug is being formed without fibrils projecting out from said plug. Additional object and advantages of the invention will be set forth.

The texturing device according to the invention is characterized by a nozzle with an inlet part, a conveying part, a compression section and a guiding part, whereat between the inlet part and the conveying part hot air or steam is let into a yarn guiding channel, which can exit within the zone of the compression section, whereat the lamellar at the outlet side of the compression section are free towards the surrounding, in particular without contact to the parts surrounding the nozzle and/or to a succeeding guiding part. In the conveying direction, a conveying part is arranged in front of the compression section and behind the compression section lays a guiding part or plug guide tube. On the inlet side of the compression section the lamellar are held by a lamellar holder, whereat the inlet side is neighboring a conveying part next to the nozzle inlet. The lamellar at the end opposing the inlet side of the nozzle freely project without support in the downward direction. The outer contour of the lamellar is either parallel to the conveying direction of the air or the textile fibres respectively, or is at a slant angle to it. In particular, at the outlet side the lamellar are slanted on their outside. Since the lamellar are arranged circularly, their outer contours around a conveying channel for a yarn plug, which lays inside the compression section, describe a contour in the form of a truncated cone-shaped shell surface. Accordingly, the succeeding guiding part or plug guide tube respectively, following the compression section is provided in the form of a truncated cone-shaped inlet funnel of the following guiding part, a gap, a ring shaped gap in particular, which preferably is of the shape of a truncated cone shall. The nozzle is to be applied as texturing nozzle for filament yarns. Following the nozzle a conveying means if arranged, for instance a pair of rollers or a drum, to convey the textured yarn or the plug respectively, the latter being furnished with a channel to guide the yarn plug.

Within a texturing device, in particular at a maximum length of the compression section of 60 mm, a guiding part at maximum of the same length follows, in which the texturized yarn in the form of a plug can be led to the surface of the drum, and then following this first guiding part, after a deviation, a second guiding part alongside the surface of the drum is provided, in that on one hand the texturized yarn is led in the radial and on the other hand in the axial direction of the drum.

The invention is being described in the following by way of the drawings.

DETAILED DESCRIPTION

Figure 1:
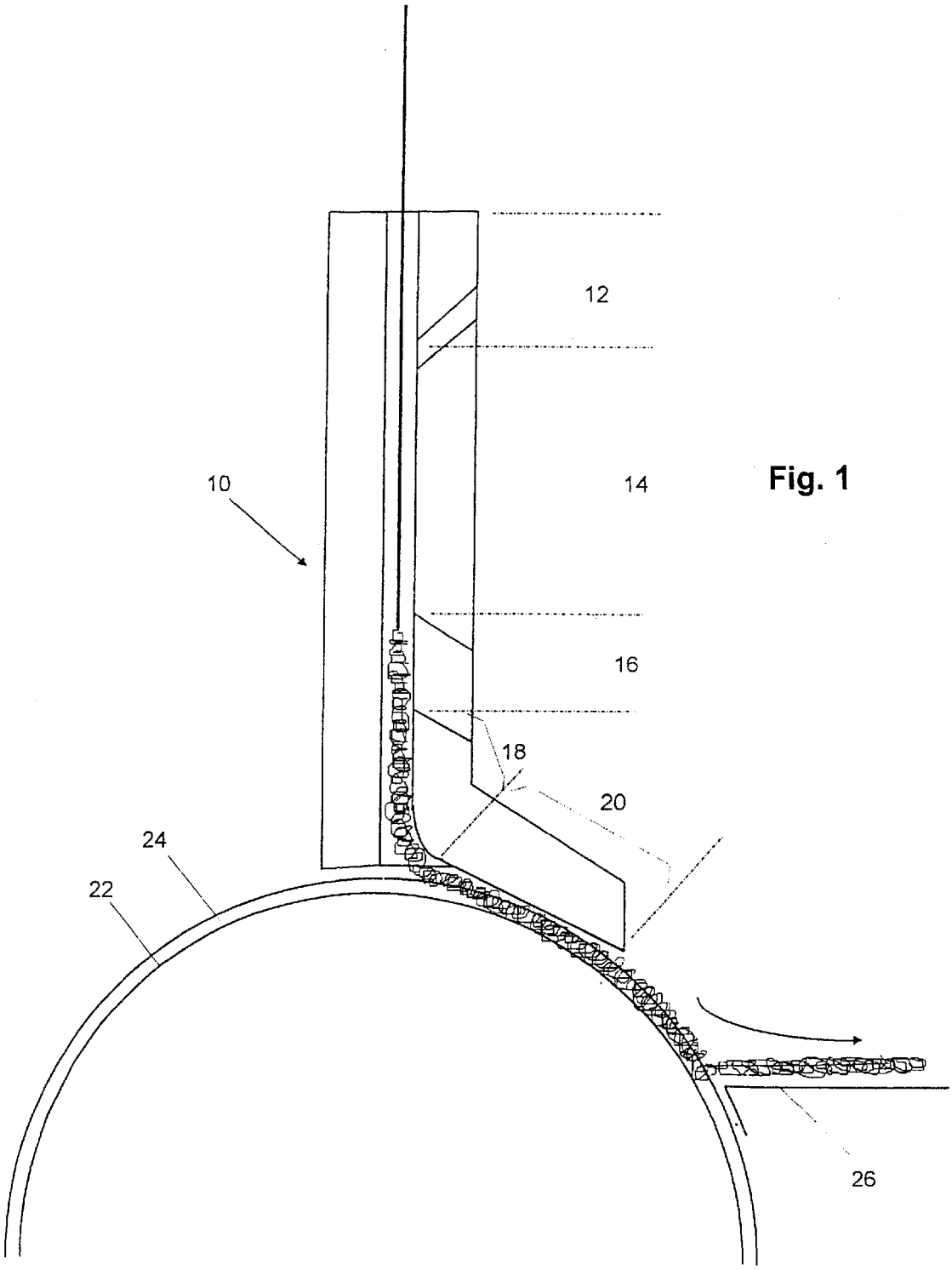
FIG. 1 is a schematic cross section of a texturing nozzle with a succeeding cooling drum from the German application DE 199 55 227.4, FIG. 2 a cross section through a texturing nozzle according to the invention in a schematic illustration, and FIG. 3 an overview of a texturing nozzle with succeeding rollers or drums respectively.

Reference will now be made in detail to embodiments of the invention, examples of which are shown in the drawings. Each example is provided by way of explanation of the invention, and not meant as a limitation of the invention. For example, features of one embodiment may be combined with those of another embodiment to yield still a further embodiment. It is intended that the invention include these and other modifications and variations.

The nozzle is shown in FIG. 1 together with a cooling drum 22. The yarn entering from above is led by an inlet part 12 down to the point at which hot air or overheated steam is fed through channels directed slantwise downwards - there can be one or several such channels. Said air together with the yarn flows through the succeeding conveying part 14 down to the inlet of the compression section 16. The compression section is preferably formed by lengthwise lamellar being arranged around the yarn or by slots, through which the hot air can leave radially outward. Within the compression section the so called plug is formed, which maintains its shape and its density within a succeeding first guiding part 18 and a second guiding part 20. Contrary to the state of the know art, the yarn plug is moved onward in such a way that it cannot expand itself. In the transition zone between the first guiding part 18 and the second guiding part 20 the yarn is deviated basically at a right angle, according to the figure in a downward direction. The second guiding part extends further over a certain length along the circumference of the rotating, perforated drum 22, on which surface the texturized yarn is guided within a channel 24. Inside the drum a sub-pressure condition is maintained so that cooling air can enter via the plug running along the surface of the drum 22 and through the perforation. By narrow guidance, the plug is hindered from making relative movement with regard to the drum. This is accomplished on one hand by way of the lateral channel walls and on the other hand by the air escaping in concentrated manner at the bottom of the channel. The plug is thus led over a circular path on the circumference of the drum 22 and maintains its form and density until the yarn is taken off the drum 22 by means of a not further shown conveying means. Only at this stage does a so called expansion of the plug take place.

Essential features of the nozzle 10 according to the invention in cooperation with a drum 22 are based on the face, that the yarn plug after leaving the compression section 16 is hindered from expanding. This is in particular achieved by the deviation between the first guiding part 18 and the second guiding part 20 as well as by way of the narrow guidance within these zones, for instance, between the second guiding part 20 and a channel 24 within the perforated drum 22. With conventional nozzles where the texturized yarn is freely placed onto the surface of the cooling drum, the yarn plug can form loops due to the lack of lateral guidance, whereat partial expansion of the plug occurs. Due to the free exit of the yarn plug at the outlet of the nozzle according to the state of the art as mentioned at the beginning, a stronger deceleration, also within the zone of the plug formation through friction, also within the compression section 16, is required, in order to achieve the necessary crimping effect. This can lead to problems, when changing operating conditions, which have an influence on the friction value.

In that the plug is being hindered from changing its shape within the guiding part 18 or 20 respectively, following the compression section 16, the texturing of the yarn within this part of the nozzle is better stabilized than in convention nozzles.

Figure 2:
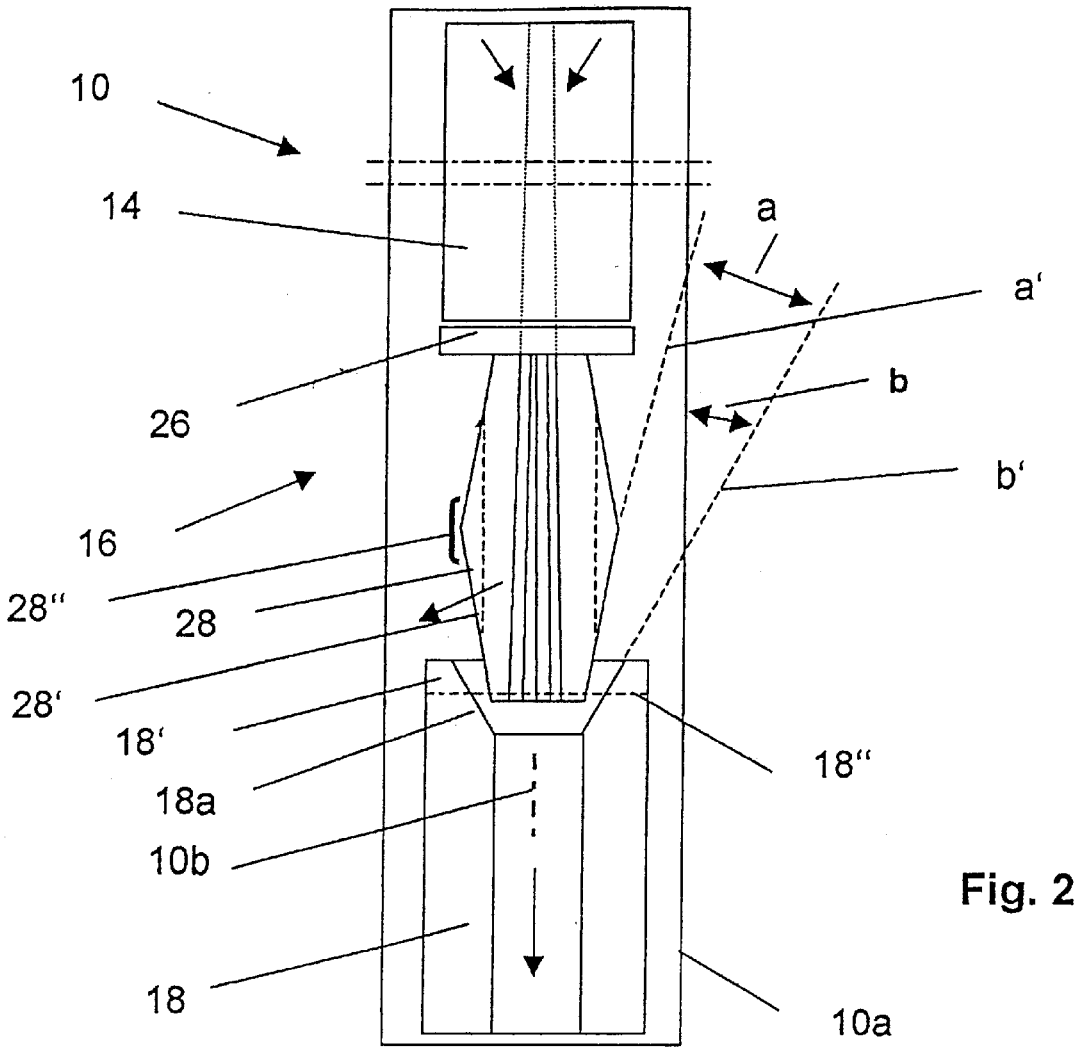

According to FIG. 2 the nozzle 10 is also divided into a conveying part 14, a compression section 16 and a guiding part 18, whereby the latter is also called plug guide tube. Into the conveying part 14 air enters into a conveying channel from the side, as is indicated by arrows shown at the top, through which conveying channel the yarn to be texturized is guided downwards. According to the exemplified embodiment, the compression section consists of a lamellar holder 26 on which at the lower end the lamellar 28 are arranged. Numerous lamellar are arranged circumferentially, so that between the lamellar slots or gaps respectively, are formed, through which, within the zone of the compression section 16, the air exits more or less radially in direction of the arrow at 28 through the slots between the lamellar. The lamellar holder 26 can be made as a flange, which either is made as a one-piece part with the lamellar 28, or the lamellar holder can carry the lamellar 28 which are inserted into the lamellar holder and which for instance are connected to it by soldering. The outer contour 28 of the lamellar can, as indicated with full lines, run slantwise to the flow direction of the air or conveying direction of the yarn respectively, or the outer contour of the lamellar is, as indicated by dotted lines, basically parallel with the flowing direction and converges at least towards the outlet side end of the plug slantwise to the conveying direction, so that at the outlet side the outer edges of the lamellar basically form the shape of a truncated cone, which truncated cone protrudes into an end piece 18 or the guiding part respectively or the plug guide tube 18, whereat the end piece 18 or the guiding part 18 respectively are also being provided with a truncated cone-shaped surface. The outlet side of the lamellar 28 and the inlet side of the end piece 18 or the guiding part 18 respectively, preferably are formed in such a way that between the outer contour 28 of the lamellar 28 and the inner surface of the end piece 18 or the guiding part 18 respectively a narrow gap of approximately constant height is formed. This gap also has the shape of a truncated cone shell.

Generally speaking, the angle between a first reference line a at the outlet contour 28 of a lamellar 28 and a second reference line b extending from the shell line of the truncated cone forming the inlet side of the guiding part 18, can form a first angle, while the second reference line b together with an edge 10*a* of the nozzle 10 includes an angle b. Preferably the following ranges are suggested for the angles a and b:

a=0 . . . 1 . . . 4° b=30 . . . 45 . . . 60° whereat the underlined values have proved preferable in practice. Between the end part 18 and the first guiding part 18 a parting plane 18 can lay.

Figure 3:
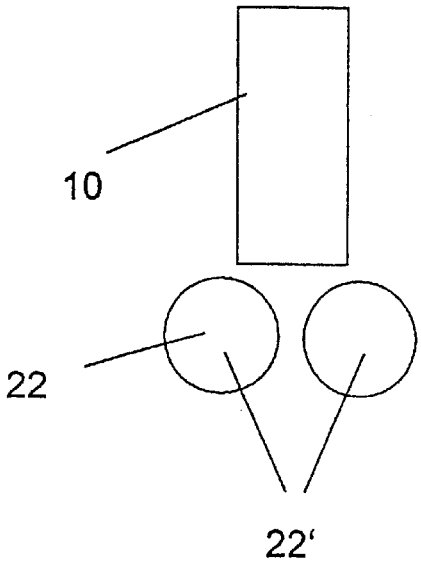

With FIG. 3 again is shown schematically that in succession of a nozzle 10 either a pair of rollers 22 for drawing off the formed yarn plug can be provided, or a single drum 22 over whose outer surface the plug is drawn off in a controlled manner, as is described in the German patent application DE 199 55 227.4. The latter application is to be considered an integrated part of the present application.

It should be apparent to those skilled in the art that modifications and variations can be made to the embodiments of the invention described herein without departing from the scope and spirit of the invention as set forth in the appended claims.

What is claimed is:

1. A yarn texturizing nozzle comprising a compression section and a guiding section disposed after said compression section in a direction of conveyance of a yarn through said nozzle, said compression section having a plurality of radially and axially oriented lamellar for forming a yarn plug, said lamellar having outlet ends in the direction of conveyance of the yarn that are unconnected to each other and surrounding parts of said nozzle such that any yarn fibers extending through gaps between said lamellar in said compression section are free to pass between said lamellar and into said guiding section.

2. The nozzle as in claim 1, further comprising a conveying part disposed before said compression section in the conveying direction of the yarn.

3. The nozzle as in claim 2, further comprising a lamellar support, said lamellar held to said lamellar support at their inlet ends, said lamellar disposed at an outlet of said conveying part in the conveying direction of the yarn.

4. The nozzle as in claim 1, wherein said lamellar comprise an outer contour that is shaped at said lamellar outlet ends so as to extend downward into said guiding section.

5. The nozzle as in claim 4, wherein said outer contours are generally parallel to the conveying direction of the yarn.

6. The nozzle as in claim 4, wherein said outer contours are angled towards a centerline axis of said compression section at least along a portion thereof adjacent said lamellar outlet ends such that said outer contours define a generally truncated cone configuration along said portions adjacent said lamellar outlet ends.

7. The nozzle as in claim 6, wherein said lamellar truncated cone configuration comprises a cone angle between about 1 degree and about 5 degrees.

8. The nozzle as in claim 6, wherein said guiding section comprises a generally truncated cone shaped inlet, said lamellar truncated cone configuration extending into said guiding section truncated cone shaped inlet.

9. The nozzle as in claim 8, wherein an angle is defined between said guiding section cone shaped inlet and said lamellar truncated cone configuration of less than about 4 degrees.

* * * * *